United States Patent [19]

Stanton

[11] 4,288,336

[45] Sep. 8, 1981

[54] PROCESS FOR PREPARING OVERBASED ALKALINE EARTH METAL SULFONATES

[75] Inventor: Garth M. Stanton, San Anselmo, Calif.

[73] Assignee: Chevron Research Company, San Francisco, Calif.

[21] Appl. No.: 182,158

[22] Filed: Aug. 28, 1980

[51] Int. Cl.[3] ..... C10M 1/40; C10M 1/22; C10M 3/16

[52] U.S. Cl. ..... 252/33; 252/52 R; C30M/3/34

[58] Field of Search ..... 252/33, 52 R

[56] References Cited

U.S. PATENT DOCUMENTS

| | | | |
|---|---|---|---|
| 2,616,904 | 11/1952 | Asseff et al. | 252/33 |
| 3,629,109 | 12/1971 | Gergel et al. | 252/33 |
| 4,094,801 | 6/1978 | Frorsberg | 252/33 |

*Primary Examiner*—Delbert E. Gantz
*Assistant Examiner*—Irving Vaughn
*Attorney, Agent, or Firm*—D. A. Newell; J. J. DeYoung

[57] ABSTRACT

Disclosed is a process for the preparation of an overbased alkaline earth metal sulfonate in which the overbasing is carried out in the presence of a solution of sugar.

8 Claims, No Drawings

PROCESS FOR PREPARING OVERBASED ALKALINE EARTH METAL SULFONATES

FIELD OF THE INVENTION

The present invention relates to a process for the preparation of overbased alkaline earth metal sulfonates.

BACKGROUND OF THE INVENTION

Within internal combustion engines working under strong load and using fuels which contain sulfur, sometimes in relatively high amounts, serious problems arise, especially with regard to lubrication. The strong acidity produced by the combustion of the fuel induces corrosion in the engine and an intense oxidation of the lubricating oil which leads to a formation of varnish and sludge.

One preferred way to counteract these detrimental effects is to incorporate an alkaline earth metal sulfonate having a high degree of alkalinity into the lubricating oil. The detergent effect of alkaline earth metal sulfonates is well known in the art.

The basic content or degree of "overbasing" is generally expressed in terms of the alkalinity value (AV) of the material and is measured by titration (ASTM D-664 and preferably D-2896) in terms of mg KOH/g. Overbased sulfonates can be made having alkalinity values of from 1-500 mg KOH/g or more depending on the method of preparation.

Overbasing is in general accomplished by one of two methods. The first method involves the neutral detergent sulfonate solubilizing extra base into the oil solution followed by filtration. This is accomplished by boiling a mixture of neutral sulfonate, base and oil. Products having an alkalinity value of about 20 are produced. See, for example, "Dispersions of Insoluble Carbonates in Oils" by Ulric B. Bray et al., Ind. Eng. Chem. Vol. 14, No. 4, 1975. A second method of overbasing is to treat the inorganic oxide, hydroxide, etc., with an acidic gas, preferably carbon dioxide, to form in situ a very finely dispersed metal carbonate. Very high alkalinity values can be obtained this way ranging from 300-500 AV or more. See, for example, U.S. Pat. No. 4,086,170.

It has also been found that a variety of supplemental compounds can be added during the various overbasing processes to aid in the incorporation of base. Representative of such compositions are dihydric alcohols containing up to 6 carbon atoms such as ethylene glycol, propylene glycol, 1,2 butanediol and the like (taught in U.S. Pat. No. 2,676,925), alcohols including glycerol, pentaerythritol and the like (taught in U.S. Pat. No. 3,242,079), and alcohols such as methanol, ethanol, sorbitol, pentaerythritol and the like (taught in U.S. Pat. No. 3,256,186 and 2,861,951).

SUMMARY OF THE INVENTION

It has been found that in a process for the production of overbased alkaline earth metal sulfonates wherein a hydrocarbyl sulfonic acid or neutral sulfonate is overbased with an alkaline earth metal oxide or hydroxide in an organic solvent, that carrying out the overbasing in the presence of a solution of a sugar greatly facilitates the overbasing.

DETAILED DESCRIPTION OF THE INVENTION

The preparation of oily concentrates of alkaline earth metal sulfonates is well known in the art. The preparation involves the reaction of a hydrocarbyl sulfonic acid or neutral sulfonate with an alkaline earth metal oxide or hydroxide in an organic solvent comprising oil and frequently also containing promoters, such as, water, methanol, ethanol or glycol and other additives which serve to increase the degree of overbasing.

The hydrocarbyl sulfonic acid is well known in the art and can be an alkyl aromatic sulfonic acid or an aliphatic sulfonic acid. The alkyl aromatic sulfonic acid may be either a natural or synthetic sulfonic acid. The aliphatic sulfonic acid is well known in the art. Preferred is polyisobutene sulfonic acid.

The sulfonic acid may be used in the process of the present invention or it may first be partially or completely neutralized using an alkaline earth metal compound thereby forming a neutral sulfonate. Generally, the sulfonic acids will contain at least twelve aliphatic carbon atoms in order to make them oil-soluble.

Suitable sulfonic acids include petroleum sulfonic acids or the acids obtained by treating an alkylated aromatic hydrocarbon with a sulfonating agent such as chlorosulfonic acid, sulfur trioxide, oleum, sulfuric acid or a combination of sulfur dioxide and chlorine or oxygen. The sulfonic acids obtained by sulfonating alkylated benzene, alkylated naphthalene, phenol, diphenyl sulfide or diphenyl oxide, and having one or more alkyl radicals, each of which contains from about 12 to about 100 carbon atoms, are especially useful. Specific examples of the sulfonic acids are mahogany acids, eicosane substituted naphthalene sulfonic acid, dodecyl benzene sulfonic acid, didodecyl benzene sulfonic acid, dinonyl benzene sulfonic acid, octadecyl diphenyl ether sulfonic acid, octadecyl diphenyl amine sulfonic acid, ethyl chlorobenzene sulfonic acid, bis-cetyl phenyl disulfide sulfonic acid, cetoxy capryl benzene sulfonic acid, dilauryl beta-naphthalene sulfonic acid, polyisobutenyl sulfonic acid, paraffin wax sulfonic acid, bright stock sulfonic acid wherein the bright stock can have a molecular weight, for example, of 750, 500 or 2,000, cetyl cyclopentane sulfonic acid, and polyethylene sulfonic acid.

The alkaline earth metal salt (sulfonate) is formed by reacting the sulfonic acid with an alkaline earth metal base, particularly the alkaline earth metal hydroxides, oxides, alkoxides, sulfides, mercaptides, or carbonates, as is well known in the art. Preferred is calcium or barium hydroxide.

The reaction is carried out in an organic solvent comprising a mineral oil. In addition to the sugar solution, other promoters, as are well known in the art can also be present, such as, the $C_1$ to $C_4$ alcohols and ethylene glycol or mixtures thereof.

The sugars useful in the present invention include both the monosaccharides and the disaccharides. Among the disaccharides are sucrose, trehalose, lactose, maltose and the like. Useful monosaccharides include both the 5-carbon pentoses and 6-carbon hexoses. Both aldose and ketose-types of monosaccharides can be used. Examples of pentoses are arabinose, ribose, lyxose, ribulose, xylulose, and the like. Examples of hexoses are glucose, mannose, galactose, fructose, sorbose and the like. The preferred disaccharide is sucrose, the preferred monosaccharides are glucose or fructose. The sugar is dissolved in a suitable highly polar solvent, such as water, acetone, ether, etc. Preferably the sugar is dissolved in water to form an aqueous solution. Ordinarily, the solution will contain from 0.1 to 35 percent by weight of a sugar and preferably from 20 to 35 percent.

The sugar solution can be added during the preparation of the alkaline earth metal sulfonate or if carbonation is desired, during the carbonation stage or as a post carbonation treatment to further increase overbasing. For example, a mixture of the neutral sulfonate with calcium hydroxide, methanol and an aqueous solution of sugar can be prepared and the product isolated directly from them. Alternatively, a solution of the neutral sulfonate, methanol, and calcium hydroxide can be carbonated, with the aqueous solution of sugar added either before or after the carbonation stage.

Recovery of the product from the process of this invention is carried out in the same manner as is conventionally used in the recovery of basic sulfonates. The mixture is usually stripped to remove the alcoholic promoting agent and the water. The additives prepared by the process of this invention are particularly good dispersants for use in lubricating oils.

Compositions containing these additives can be prepared by mixing, by conventional techniques, the appropriate amount of the sulfonate with a lubricating oil. The selection of the particular base oil depends on the contemplated application of the lubricant and the possible presence of other additives. Generally, the amount of the sulfonate in the finished oil will vary from 0.1% to 20% by weight, and preferably from 2% to 5% by weight.

The lubricating oil which may be used in this invention includes a wide variety of hydrocarbon oils, such as naphthenic bases, paraffin bases, and mixed base oils as well as synthetic oils, such as esters and the like. The lubricating oils may be used individually or in combination and generally have a viscosity which ranges from 7 to 1,100 cSt and usually from 20 to 325 cSt at 40° C.

In many instances it may be advantageous to form concentrates of the sulfonate additive within a carrier liquid. These concentrates provide a convenient method of handling and transporting the additives before a subsequent dilution in use. The concentrate contains an effective amount of the sulfonate which may vary from 99% to 20% by weight, although it is preferred to maintain a concentration between 75% and 40% by weight.

If desired, other additives may be included in the lubricating oil compositions. These additives include anti-oxidants or oxidation inhibitors, dispersants, rust inhibitors and anti-corrosion agents and so forth. Also anti-foam agents, stabilizers, anti-stain agents, tackiness agents, anti-chatter agents, pour point improvers, anti-squawk agents, extreme pressure agents, odor control agents, and the like may be included.

The following examples are presented to illustrate the operation of the invention and are not intended to be a limitation upon the scope of the claims.

EXAMPLE I

To a 10-gallon mixer was added 17.50 kilograms of an oil solution containing 45% of a neutral calcium alkylaryl sulfonate, 4,620 ml of methanol, 1,400 grams of lime and a solution of 1,050 grams sugar in 13,300 grams of water. The mixture was heated and stirred slowly for 45 minutes at a temperature from 18°-24° C. The temperature of the reaction mixture was increased to 110° C. over a period of about 5 hours. The mixture was then stripped to 170° C. and 48 mm Hg and then filtered at 170° C. to yield 11,200 grams of product having an alkalinity value (ASTM D-2896) of 36.9.

EXAMPLE II

A run was carried out in essentially the same way as in Example I except on a commercial scale and without sugar. The product had an alkalinity value of about 18 (ASTM D-2896).

EXAMPLE III

To a 10-gallon reactor was added 17 kg of the calcium sulfonate described in Example I, 3.25 kg of methanol, and 1.36 kg of lime. The mixture was heated to 38° C. and carbonated with 340 grams carbon dioxide over a period of 3 hours. At the end of the carbonation 680 grams water was added. The mixture was stripped to 160° C. and maximum vacuum. It was then filtered through diatomaceous earth to yield a product having an alkalinity value of 62.7 (ASTM D-2896).

EXAMPLE IV

To a 10-gallon reactor was added 17 kg of the calcium sulfonate described in Example I, 3.25 kg of methanol, and 1.36 kg of lime. The mixture was heated to 38° C. and carbonated with 340 grams carbon dioxide over a period of 3 hours. At the end of the carbonation 680 grams of sugar dissolved in 6.8 kg water was added. The mixture was stripped to 160° C. and maximum vacuum. It was then filtered through diatomaceous earth to yield a product having an alkalinity value of 78. (ASTM D-2896).

Comparison of Examples I and II demonstrates the increase in alkalinity value when a sugar solution is used as a promoter.

Comparison of Examples III and IV demonstrates the increase in alkalinity value when a combination of carbonation and a sugar solution promoter are utilized.

What is claimed is:

1. In a process for the preparation of an overbased alkaline earth metal sulfonate in which a mixture of a hydrocarbyl sulfonic acid or neutral sulfonate in an organic solvent comprising a mineral oil, is overbased with an akaline earth metal base, the improvement comprising carrying out said overbasing in the presence of a solution of a sugar.

2. The process of claim 1 wherein said solution is an aqueous sugar solution.

3. The process of claim 2 wherein said alkaline earth metal is calcium or barium.

4. The process of claim 3 wherein said sugar is glucose, galactose, or fructose.

5. The process of claim 3 wherein said sugar is sucrose.

6. The products prepared by the process of claim 1, 2, 3, or 4.

7. A lubricating oil composition comprising an oil of lubricating viscosity and an effective amount as a dispersant of the product of claim 5.

8. A lubricating oil concentrate containing an oil of lubricating viscosity and from 1 to 80% by weight of the product of claim 5.

* * * * *